US005612493A

United States Patent [19]

Alexander

[11] Patent Number: 5,612,493

[45] Date of Patent: Mar. 18, 1997

[54] METHOD OF DETERMINING GAS-OIL RATIOS FROM PRODUCING OIL WELLS

[76] Inventor: Lloyd G. Alexander, 1319 Klondike Avenue S.W., Calgary, Alberta, Canada, T2V 2L9

[21] Appl. No.: 635,168

[22] Filed: Apr. 25, 1996

[51] Int. Cl.[6] ..... G01V 1/00; E21B 49/00; G09B 23/40

[52] U.S. Cl. ..... 73/152.55; 364/420; 324/323; 367/14; 73/152.18; 73/19.1; 166/250.01

[58] Field of Search ..... 73/152.55, 152.18, 73/19.11; 364/804, 420, 421; 166/250; 324/346, 323, 324; 367/14

[56] References Cited

U.S. PATENT DOCUMENTS

| | | | |
|---|---|---|---|
| 4,398,416 | 8/1983 | Nolte | 73/155 |
| 4,442,895 | 4/1984 | Lagus et al. | 166/250 |
| 4,453,595 | 6/1984 | Lagus et al. | 166/250 |
| 4,635,719 | 1/1987 | Zoback et al. | 166/250 |
| 4,821,164 | 4/1989 | Swanson | 364/420 |
| 4,991,095 | 2/1991 | Swanson | 364/421 |
| 5,151,658 | 9/1992 | Muramatsu et al. | 324/346 |
| 5,497,658 | 3/1996 | Fletcher et al. | 73/151 |

*Primary Examiner*—Hezron E. Williams
*Assistant Examiner*—J. David Wiggins
*Attorney, Agent, or Firm*—Dennis T. Griggs

[57] ABSTRACT

A method is provided for simulating a linear solution gas curve for the determination of the gas-oil ratio for a crude oil well at any pressure using only surface measurements of the well's annular gas rate, a determination of the flowing bottom hole pressure, and knowledge of the bubble-point pressure. From the resulting curve, relationships can be formulated for determining the total produced gas rate. In an alternate embodiment, knowing the total gas rate for a crude oil well, a solution gas curve is simulated and the above relationships can be applied in reverse manner to predict several well characteristics, including either of the crude oil bubble-point pressure, the flowing bottom hole pressure, or the annular gas rate.

7 Claims, 4 Drawing Sheets

METHOD OF DETERMINING GAS-OIL RATIOS FROM PRODUCING OIL WELLS

FIELD OF THE INVENTION

This invention relates to a method for determining the gas-oil ratio for a crude oil and gas flow rates for a pumping well, in particular the rate of gas released from tubing oil production.

BACKGROUND OF THE INVENTION

When crude oil from a subterranean reservoir is raised to the surface and thereby reduced in pressure, solution gas is released. The quantity of gas released is dependant upon the crude oil's gas-oil ratio or GOR. Produced oil is ultimately stored in atmospheric tankage, and any associated gas which has come out of solution is typically vented from the tank. Regulatory boards are cautious regarding the quantities of gas vented from oil well sites.

For oil fields in Alberta, Canada, the Energy Resources Conservation Board (ERCB) requires an operator to continuously measure the volume of gas produced from the crude oil-producing well. An operator of a well producing only a low rate of gas may apply for an exemption from continuous measurement under ss. 14.040 and 15.140 of the Alberta Oil and Gas Conservation Regulations. This exemption is typical in heavy oil operations but also frequently occurs in conventional oil production areas. Unfortunately, at low gas rates, it is difficult to obtain gas measurement using conventional orifice-based measurement devices. One approach is to install a separator and measure the rates. Separators involve a further capital expense and require maintenance.

The objective is to measure these low gas flow rates on wells not normally equipped with separators.

More particularly, an oil well comprises a large bore casing string extending downwardly to access the subterranean oil reservoir. A production tubing string extends down the bore of the casing, forming an annulus therebetween. A downhole pump at the lower end of the tubing pumps oil up the bore of the tubing for production at the surface.

The annular space accumulates gas which is produced to lower the static pressure in the well. The gas in the annulus results from the reduction in crude oil pressure from the reservoir pressure to the annular pressure. Production of gas from the annulus is necessary to remove the produced gas which otherwise must pass through the crude oil pump and tubing string, reducing its efficiency.

Oil produced from the tubing string is reduced from the annular pressure at the pump (flowing bottom hole pressure) to the low pressure at the surface. This reduction in pressure is further associated with the release of more solution gas. The oil and released solution gas is produced from the tubing string and combined with the annulus gas flow, all of which is directed to tankage.

Therefore, in order to measure the total produced gas rate, it is necessary to measure both the annular gas and the tubing gas rates.

In the first instance, it is relatively straightforward to connect a critical flow prover or positive displacement meter to the annulus and measure its substantially liquid-free gas flow on a continuous basis prior to its joining the tubing flow. However, the tubing gas flow is not so easily measured.

The tubing gas flows concurrently with oil production and is not readily measured as a mixed liquid and gas.

Ideally, an oil-gas separator is installed for providing measurable, separate gas and oil flow rates. However, many sites do not incorporate a separator due in part to low produced flow rates, the cost or the requirement for ongoing maintenance. Accordingly, the gas rate may not be directly measured.

For conventional oil production, the ERCB requires a representative 24-hour production test in order to establish eligibility for exemption and determination of an appropriate GOR to be used for ongoing production purposes. The 24-hour test typically comprises temporarily installing a temporary oil-gas separator in-line and determining the relative flows of oil and gas. Should an exemption be granted, annual 24-hour tests are required to determine continuing eligibility and to update the GOR value.

For the annual tests the ERCB states that consideration should be given to using positive displacement meters for conducting GOR tests at gas rates below 500 $m^3/d$. In accordance with the invention, a graphical method of determining the gas rate is provided which eliminates the need for supplementary equipment, and significantly reduces time required for testing as prescribed by the ERCB. As an added benefit, gas-oil ratio information for the crude oil is determined which is of significant reservoir engineering importance as diagnostic tool for monitoring and implementing reservoir depletion strategies.

SUMMARY OF THE INVENTION

In one aspect of the invention, a method for creating a simulated solution gas curve for oil produced from a crude oil well is provided, said well having a tubing string extending through the casing string of a wellbore and forming an annular space therebetween, said tubing having a bore for delivering pumped crude oil to the surface at a known oil production rate, the oil being produced from a subterranean reservoir initially at the crude oil's bubble-point or higher pressure, any gas within the annular space being produced, the method comprising:

obtaining the bubble-point of the crude oil;

determining the gas flow rate produced from the annular space;

determining the flowing bottom hole pressure of the well;

normalizing the annular space gas flow rate by dividing by the oil production rate;

comparing the normalized annular gas rate to the reduction in pressure from the bubble-point pressure to the flowing bottom hole pressure as representing a linear relationship of the quantity of solution gas released from the produced oil as its pressure is reduced; and creating a simulated solution gas curve representing the gas-oil ratio of solution gas contained in the oil at any pressure by forcing the intersection of said linear relationship through the conditions at zero solution gas remaining to be released from the oil at zero pressure.

The simulated solution gas curve enables ready determination of the total gas flow from the tubing string in the well as being the solution gas released between the bubble point and zero gauge pressure at the surface, where atmospheric pressure equals zero gauge pressure.

In another aspect of the invention, should the total gas rate already be known, the linear relationship of the solution gas curve as a function of pressure is readily simulated from the two points now available, that being the total gas rate, normalized for oil production, at the bubble point pressure and the origin at zero solution gas and zero pressure.

DETAILED DESCRIPTION OF THE PREFERRED EMBODIMENT

Figure 1:
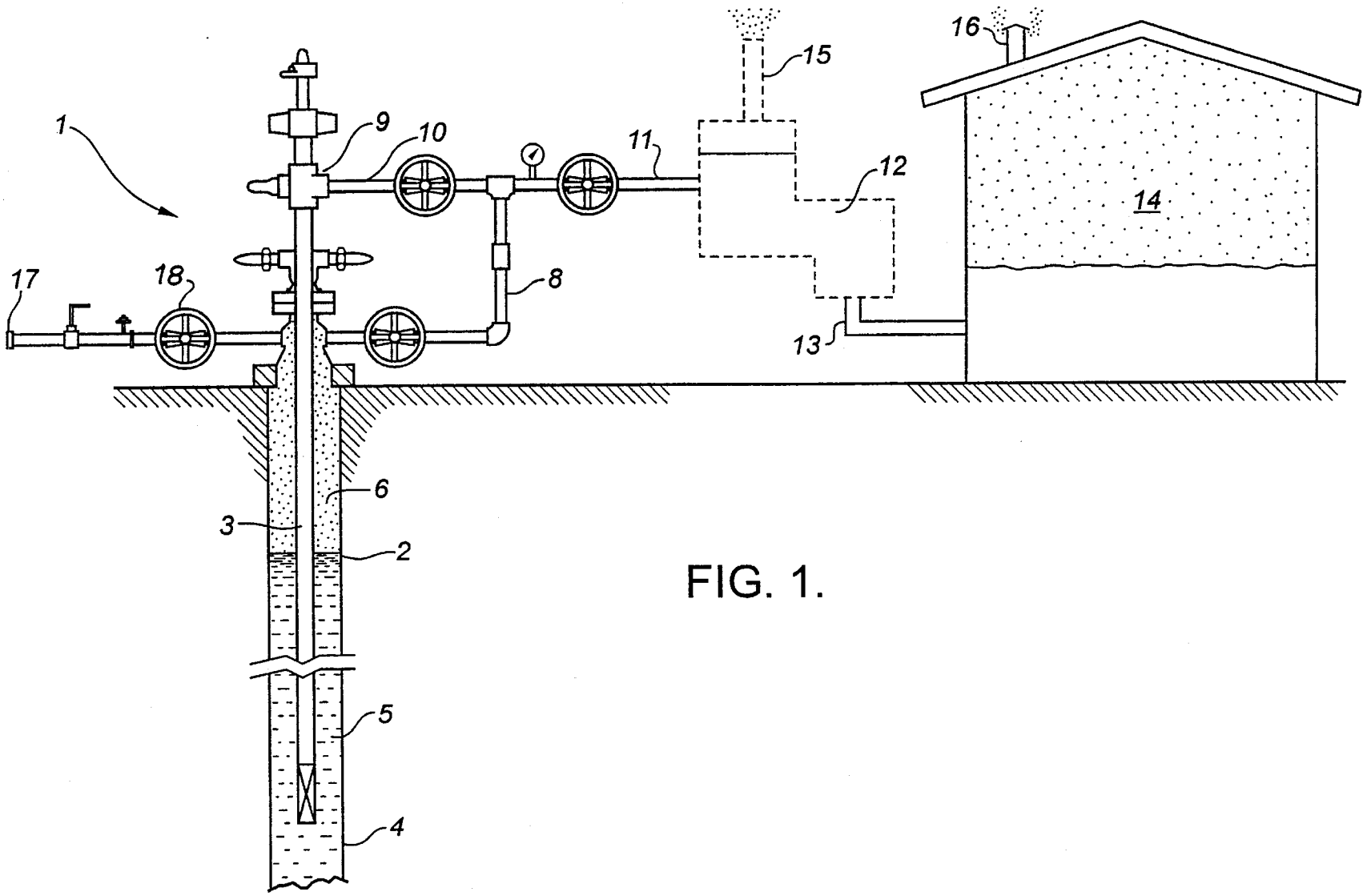
FIG. 1 is a cross-sectional representation of a conventional crude oil well and associated surface equipment.

Having reference to FIG. 1, a conventional well is shown comprising a wellhead 1, well casing 2, and a tubing string 3 extending downwardly inside the bore of the casing 2. The casing 2 is perforated adjacent its bottom end 4 for permitting reservoir fluid 5 to flow into the annulus 6 formed between the casing 2 and the tubing string 3.

The wellhead 1 provides an annulus gas outlet 7 having a gas conduit 8 and tubing outlet 9 having oil conduit 10, both of which interconnect at tankage conduit 11 to form a mixed product. Separator 12 (shown in phantom lines) may or may not be present for separation of product into oil conduit 13 for discharge of separated oil into stock tank 14 and gas conduit 15 for venting or flaring of separated gas.

If no separator 12 is installed then all product from conduit 11 is directed through conduit 13 to tank 14. Any gas associated with product entering the tank through conduit 13 is vented through tank vent 16.

While the gas rate from the annulus can be measured directly by a positive displacement gas meter or orifice meter temporarily inserted into conduit 8, it can also be readily calculated using the methodology described in applicant's Canadian Patent, Ser. No. 1,063,009, which issued on 25 Sep. 1979 (equivalent U.S. Pat. No. 4,123,937). Similarly, the flowing bottom hole pressure can be calculated from a sonic fluid level, or, as has been disclosed in Canadian Patent 1,063,009 it can be calculated using a pressure gradient of the liquid which is consistent with its pressure and temperature.

Dealing briefly with the prior art method of calculating annulus gas volume and flow rate ($q_1$), as disclosed in Canadian Patent 1,063,009, the method comprises measuring the change in annular pressure over time for two sets of annular flow conditions on the well; one set while temporarily blocking flow from annulus, and a second set while controlling and measuring the flow rate of gas from the annulus. Means for measuring annular gas rates include a critical flow prover 17 installed on the wellhead 1. The prover 17 comprises a vent plate having a vent orifice of predetermined calibrated size and a valve 18 to selectively open and close the gas path between the wellhead and the prover 17. Two mass flow equations are then solved resulting in the general relationship:

$$q_1 = \frac{q_2\left(\frac{dP}{dt}\right)_1}{\left(\frac{dP}{dt}\right)_1 - \left(\frac{dP}{dt}\right)_2} \tag{1}$$

where ($q_1$) is the annular gas rate;

$(dP/dt)_1$ is the rate of change in gas pressure determined with the valve 18 closed;

$(dP/dt)_2$ is the rate of change in the gas pressure with the valve 18 open; and $q_2$ is the flow rate through the critical flow prover or positive displacement meter, whichever is used.

As is commonly known, bottom hole pressure is determined by adding the pressure at the oil/gas interface in the annulus, to the pressure exerted by the oil column.

What is left now to determine is the tubing gas rate, which is the amount of gas that breaks out of the oil as it is brought up the tubing string from the initially high pressure of the flowing bottom hole pressure to the lower pressure of the storage tankage, which is usually at atmospheric pressure.

Figure 2:
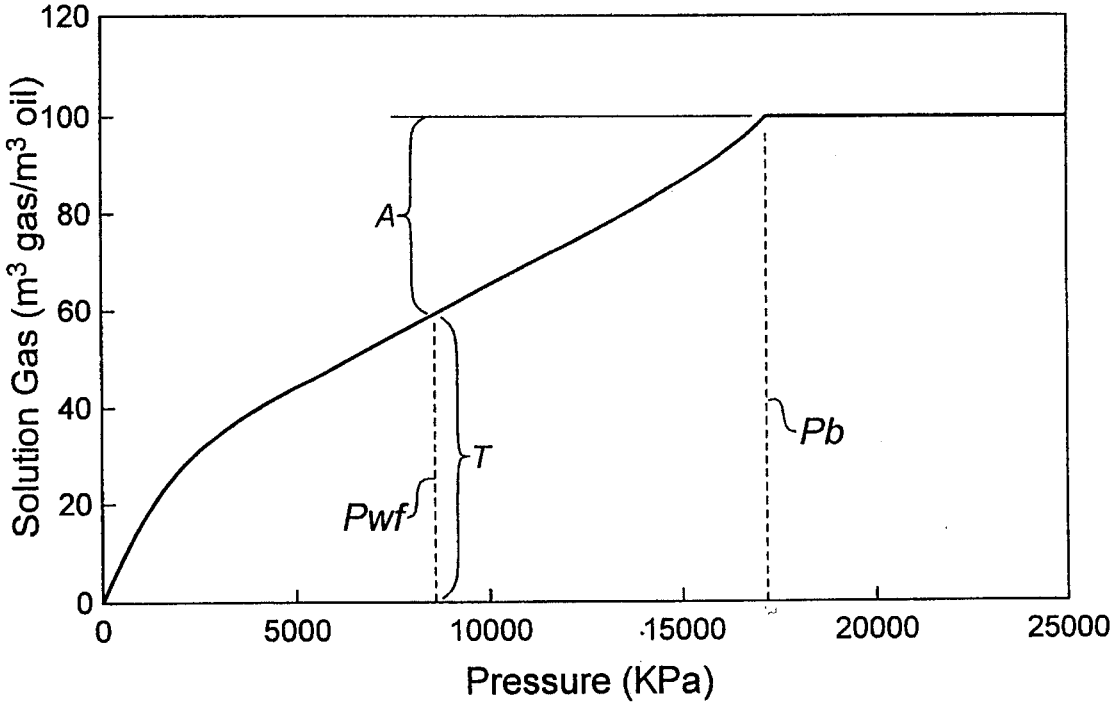
FIG. 2 depicts a solution gas curve which is a graphical representation of the relationship between the amount of gas dissolved in solution in the crude oil as a function of pressure.

Having reference to FIG. 2, an empirically determined solution gas curve is shown for a crude oil, typical of the relationship between the amount of gas held in solution, as a function of pressure. It is derived from extensive and expensive laboratory tests on the specific crude oil in question. This relationship is not often known for a particular reservoir. From such a graph the amount of gas liberated and the amount of gas held in solution, through any differential change in pressure, can be determined.

For example, should the pressure of the crude oil be reduced from the bubble-point pressure ($P_b$) of about 17,250 kPa, to atmospheric of zero kPa, then about 101 $m^3$ of gas is released from solution for every $m^3$ of oil produced.

As the pressure drops from the bubble-point pressure shown of 17,250 kPa, to the flowing bottom hole pressure ($P_{wf}$) of about 8,270 kPa, an amount of gas A is liberated from the oil, which appears in the annulus. Then, as obtained from FIG. 2, the amount of gas held in solution is seen to be reduced from 101 to 60 $m^3$ gas/$m^3$ oil resulting in a net release of 41 $m^3$ gas/$m^3$ oil.

Further, as the pressure in the well drops further from bottom hole pressure to ambient or zero pressure at the surface (representing the tubing production), more gas is released. This gas is released as the tubing gas rate and is 60–0=60 $m^3$ gas/$m^3$ oil.

At an oil production rate of 16 $m^3$/d, the annular gas rate is 16×41 or 656 $m^3$/d. Similarly the tubing gas rate is 16×60 or 960 $m^3$/d. Thus, the total gas rate is 656+960=1616 $m^3$/d. This gas rate would report through an installed gas separator. Having come full circle, the gas-oil ratio in this case would be (1616/16) or 101 $m^3$ gas/$m^3$ oil which is the amount of gas held in solution at the bubble-point pressure.

From the above, it is clear that if the solution gas curve were available, it would be a straightforward task to determine the total separator gas, using known values for oil production rate and reservoir pressure alone.

Unfortunately, a graph showing the relationship of pressure versus gas in solution is not available for most oil reservoirs.

Therefore, in one embodiment of the invention, a simulated representation of a solution gas curve is created, based upon the determination of certain physical well characteristics that can be readily determined.

Generally, the method comprises approximating a solution gas curve with a linear relationship. The empirical solution gas curve shown in FIG. 2 demonstrates a somewhat greater deviation from linearity than is usual, and generally, a linear approximation of the curve will not result in significant error.

As was demonstrated in FIG. 2 above, region A between 101 and 60 $m^3$ gas/$m^3$ oil represents the annular gas rate and the region T between 60 and 0 $m^3$ gas/$m^3$ oil represents the tubing gas rate. Clearly the total of A and T yields the total gas rate.

More particularly, in order to construct this linear relationship it is necessary to know the slope and intercept of the line or at least two points to properly anchor the linear relationship.

Figure 3:
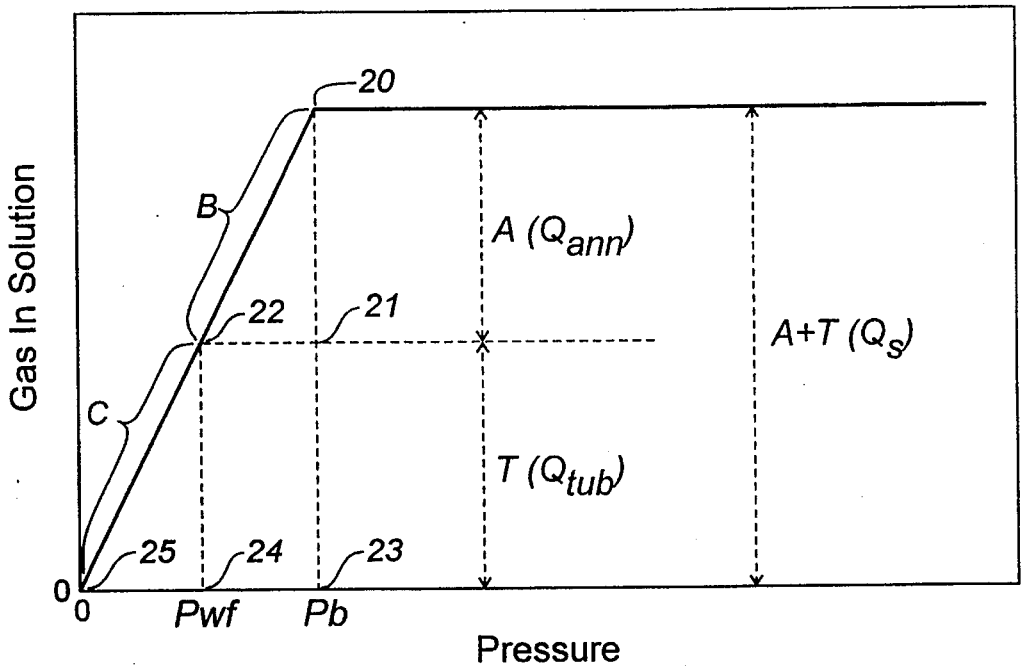
FIG. 3 depicts a simulated solution gas curve which is created using the method of the invention.

Referring to FIG. 3, the slope of the linear relationship may be established by performing tests whereby the annular gas rate $Q_{ann}$, A and the flowing bottom hole pressure $P_{wf}$ may be determined, and relating that gas flow with the net differential in pressure which liberated that quantity of gas. More particularly, the tests relate to the quantity of gas which is liberated A as the pressure drops from the high bubble-point pressure $P_b$ in the reservoir to the lower pressure flowing bottom hole pressure $P_{wf}$. Normally the bubble-point pressure $P_b$ is provided by the well operator, but the ratio of gas in solution is not. This ratio is represented by line B.

Then, the intercept at the graph origin (0,0) is introduced, knowing that the linear relationship must pass through the solution graph origin at zero gas in solution at zero pressure (atmospheric pressure=0 gauge). Accordingly, line C completes the linear approximation of the solution gas curve.

The resulting simulated solution gas relationship permits a variety of relationships to be developed for describing the crude oil well's behaviour and characteristics. One such benefit is the determination of the total gas flow rate $Q_s$ which is equivalent to the gas flow that which would be measured if a separator were installed.

For convenience a summary of the nomenclature for the relationships and equations is as follows:

$P_b$—Bubble-point Pressure–KPa $P_s$—Static Reservoir Pressure–KPa $P_{wf}$—Flowing bottom hole Well Pressure–KPa $Q_s$—Separator Gas Rate–$Sm^3/m^3$ (S—standard conditions)

$Q_{ann}$—Annular Gas Rate–$Sm^3/m^3$ $Q_{tub}$—Tubing Gas Rate–$Sm^3/m^3$

Using a comparison of similar triangles, the ratio of the triangle 20,23,25 for the total separator gas rate ($Q_s$) to the bubble-point pressure ($P_b$) is proportional to:

the ratio of the triangle 22,24,25 for tubing gas rate ($Q_{tub}$) released between the flowing bottom hole pressure ($P_{wf}$) and atmosphere pressure at zero pressure gauge; and the ratio of the triangle 20,21,22 for annular gas rate ($Q_{ann}$) released between the bubble-point pressure ($P_b$) and the flowing bottom hole pressure ($P_{wf}$).

expressed in equation form as:

$$\frac{Q_s}{P_b} = \frac{Q_{ann}}{P_b - P_{wf}} = \frac{Q_{tub}}{P_{wf}} \tag{2}$$

and knowing that the total gas rate=annular gas rate+tubing gas rate (A+B), then $$Q_s = Q_{ann} + Q_{tub} \tag{3}$$

and, finally $$Q_s = Q_{ann} + Q_{ann}\frac{P_{wf}}{P_b - P_{wf}} \tag{4}$$

or in terms of a typical linear relationship of y=mx+b; where Q is the solution gas remaining in solution in the crude oil at pressure P.

$$Q = \frac{Q_{ann}}{P_b - P_{wf}} \cdot P + 0 \tag{5}$$

In an alternate embodiment, should the total separator gas rate be known, and using the above relationships developed for the simulated solution gas curve, the bubble-point pressure $P_b$ and the flowing bottom hole pressure $P_{wf}$ may be determined.

Re-arranging equation (4) and solving for pressure, then:

$$P_b = \frac{Q_s P_{wf}}{Q_s - Q_{ann}} \tag{6}$$

$$P_{wf} = \frac{P_b(Q_s - Q_{ann})}{Q_s} \tag{7}$$

For saturated reservoirs, the static pressure $P_s$ can be substituted for the bubble-point pressure $P_b$.

From equation (4), the total separator flow rate is determined. Substituting into equation (3), the tubing gas rate is calculated.

All the necessary characteristics of a well are now known to enable calculation of the GOR or, in the case where an operator is seeking continuous measurement exemption, the stock tank rate venting rate.

Application of the methods of the invention are made by reference to two examples.

EXAMPLE I

The following test utilized well data supplied by the well operator, including the value of the bubble-point pressure. Values for the annular gas rate and the flowing bottom hole pressure of the well were calculated using methods described in Canadian Patent No. 1,063,009 issued to applicant.

| | |
|---|---|
| Well Data | |
| Mid point of perforations | 769.7 m |
| Oil Rate | 6.6 $m^3/d$ |
| Tubing Depth | 746.86 m |
| Water Rate | 1.2 $m^3/d$ |
| Water gradient | 10.00 KPa/m |
| Oil gradient | 9.39 KPa/m |
| Annular capacity | .00845 $m^3/m$ |
| Bubble-point press. | 10091 KPa ($P_b$) |
| Field Measurements | |
| Annulus Temp. | 7.02 deg. C. |
| Meter Flow rate | 84.76 $m^3/d$ |
| Gas Gravity | 0.64 |
| Annulus build up tests: | |
| Condition 1 - No external flow: $(dP/dt)_1$ - Slope $m_1$ | 5.405 KPa/min |
| condition 2 - Flow through critical flow prover: $(dP/dt)_2$ - Slope $m_2$ | 2.044 KPa/min |
| Test Results | |
| Z-Factor | 0.9933 |
| Combined fluid grad. | 9.4838 KPa/m |
| Wellbore volume | 6.5040 $m^3/d$ |

-continued

| | |
|---|---|
| Annular gas volume | 1.7490 $m^3$ |
| Gas oil interface pressure | 262.233 KPa |
| Pressure due to liquid | 5285.841 KPa |
| Depth to fluid | 207.003 m |
| Flowing bottom hole press. | 5548.074 KPa ($P_{wf}$) |
| Annular gas flow rate | 136.307 $M^3/d$ ($Q_{ann}$) |

It was convenient to normalize the annular gas rate of flow by dividing the measured gas rate in $m^3$ gas/day by the product oil flow rate at 6.6 $m^3$ oil/day, yielding the gas-oil ratio or solution gas in $m^3$ gas/$m^3$ oil.

Figure 4:
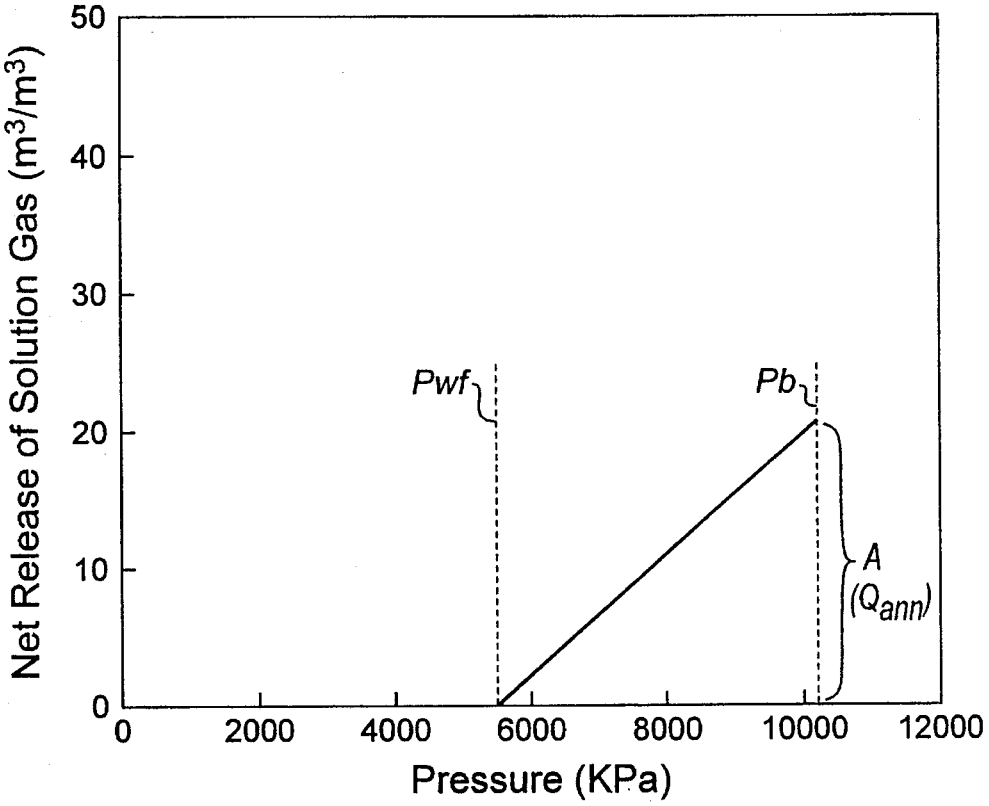
FIG. 4 illustrated a preliminary step in the construction of a linear solution gas graph in accordance with one embodiment of the present invention, wherein A is the net gas liberated due to the reduction in pressure from the bubble-point to the flowing bottom hole pressure.
Figure 5:
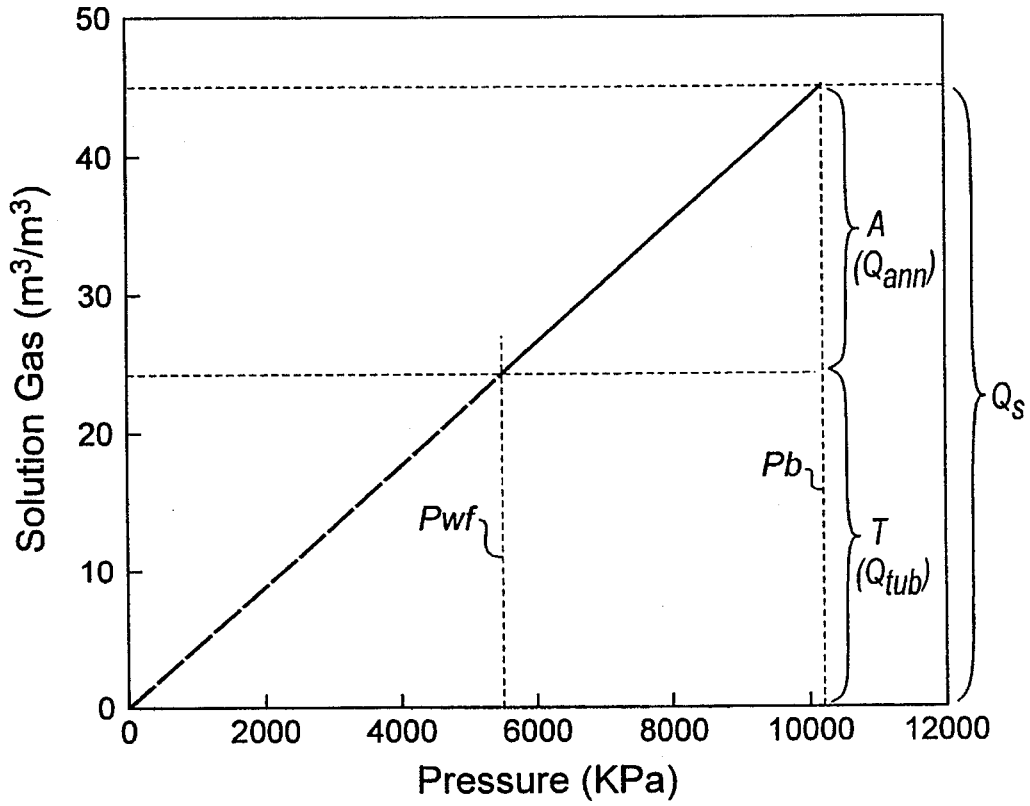
FIG. 5 illustrates the final step in the construction of the linear solution gas graph of FIG. 3 wherein the total separator and tubing quantities of gas liberated can be determined.

Having reference to FIGS. 4 and 5, the normalized annular gas rate was 136.307/6.6=20.653 $m^3$ gas/$m^3$ oil. In other words, as a result of the pressure drop from a bubble-point pressure of 10091 kPa, to the flowing bottom hole pressure of 5548 kPa, a net quantity of 20.653 $m^3$ of gas was released for every $m^3$ of oil produced.

The slope of the resulting linear relationship was calculated as:

$$\text{slope} = \frac{(Q_{ann} - 0)}{(P_b - P_{wf})} = 0.004546$$

resulting in an interim linear relationship (y=mx+b) being= 0.004546(pressure)–25.2218

Next, for alignment with the y-intercept, this interim relationship was translated upwards, moving it vertically without horizontal movement, and the linear relationship was extended to pass through the y-intercept at the origin. Thus, a relationship for solution gas as a function of well pressure was simulated.

Now that the simulated solution gas curve for that reservoir is was created, the total gas rate could then be determined.

Solved graphically, the total equivalent separator gas rate is determined to be that quantity of gas released between the bubble-point pressure and zero, being about 46 $m^3$ gas/$m^3$ oil. At 6.6 $m^3$ oil/day the total separator gas rate is 46*6.6= 304 $m^3$/d.

Alternatively, knowing values for $P_b$, $P_{wf}$ and $Q_{ann}$, one can solve for the total separator gas rate by substituting the above values into equation (4) as follows:

$$Q_s = 136.307 + 136.307 * 5548.074/(10091 - 5548.074) = 303.77\ m^3/d.$$

Working in reverse order of the graphical approach, at 6.6 $m^3$/d of oil the gas-oil ratio or $$GOR = 303.77/6.6 = 46\ m^3/m^3.$$

Note that the testing for this example required only in the order of 20 minutes, not the 24 hours required by the ERCB for temporary separator installations.

EXAMPLE 2

Further, implementation of the alternate embodiment enables significant advantages for optimizing well production. In particular, in one test well situation, the following pertinent well data was determined:

Well Data measured separator gas rate=1192 $m^3$/d measured oil rate=5.16 $m^3$/d known bubble-point pressure=15396 kPa ($P_b$)

flowing bottom hole pressure=11109 kPa ($P_{wf}$)

The normalized total gas rate $Q_s$ was calculated as 1192/5.16=231.0078 $m^3/m^3$.

Figure 6:
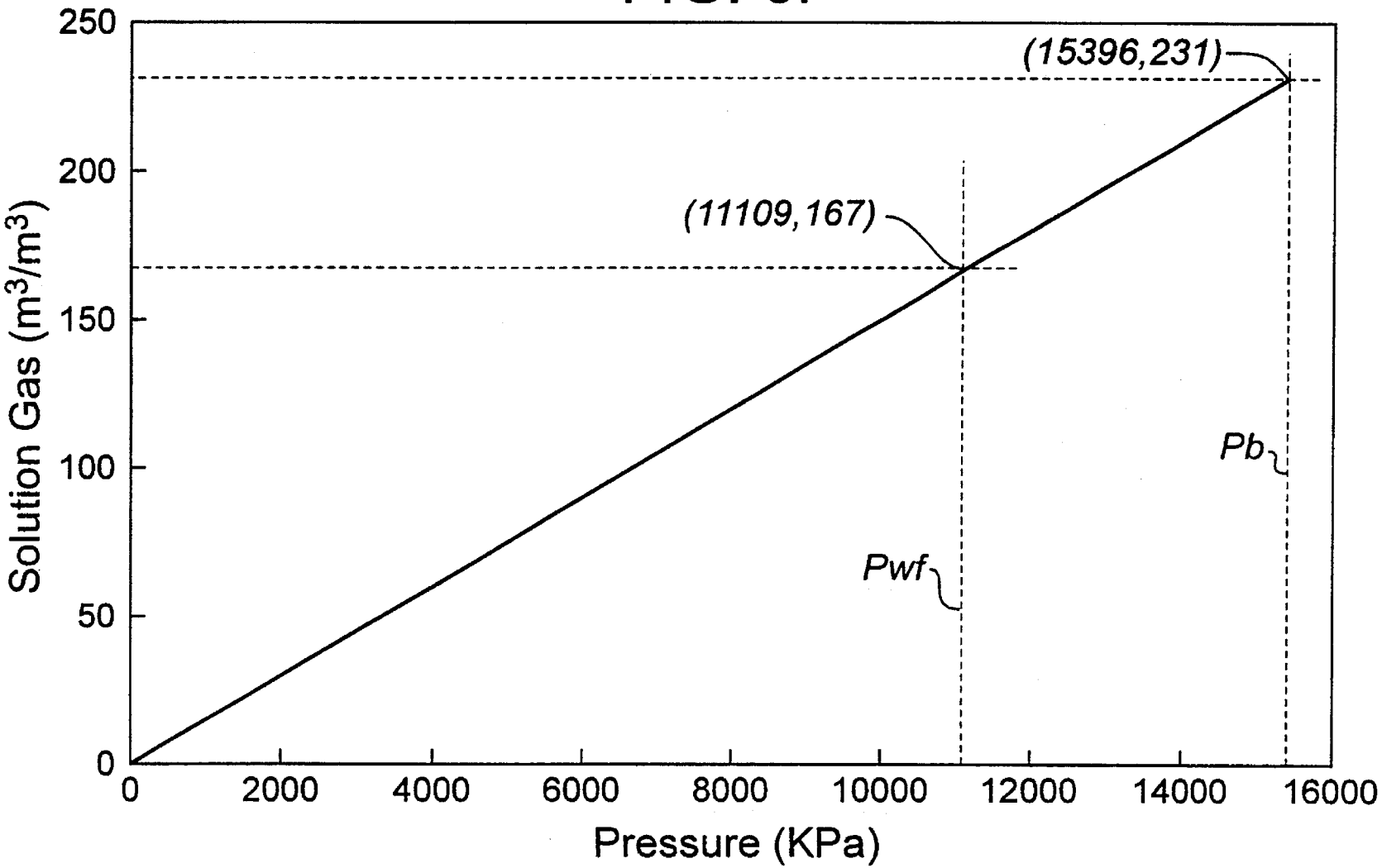
FIG. 6 is a simulated solution curve constructed in accordance with an alternate embodiment of the invention, from which well characteristics, other than total separator gas rate may be determined.

FIG. 6 represents the simulation of the solution gas curve, constructed from knowledge of the normalized total gas rate at the bubble-point pressure as one point and the origin as the second point. The derived equations (1)–(7) apply. Specifically, the curve was constructed from the first point at 231.0078 $m^3/m^3$ and 15396 kPa, and the second point at the origin at zero gas in solution and zero pressure Graphically, one can reference the flowing bottom hole pressure of 11109 kPa and determine that the solution gas remaining in the oil was about 167 $m^3/m^3$, for a net theoretical amount of gas liberated, as annular gas, of 231–167=64 $m^3/m^3$. At 5.16 $m^3$/d of oil production, this results in 330 $m^3$/d of annular gas rate.

Calculation can produce a more accurate value, by bypassing the simulated graph entirely and going directly to derived equation (4) and rearranging for calculation of annular gas rate as follows:

$$Q_{ann} = \frac{Q_s}{1 + \frac{P_{wf}}{P_b - P_{wf}}}$$

or 231.0078/(1+11109/(15396–11109))=64.3239 which gives an annular gas rate of 331.91 $m^3$/d. This represents the theoretical annular gas rate should all solution gas ideally report for production through the annulus.

Next, an actual annular gas rate was determined for this well, measured in this case at only 240 $m^3$/d. The simulated solution gas curve predicted that 332 should have been released. So, the question became, where did the liberated solution gas report?

It could be deduced that 332–240=92 $m^3$/d of gas was passing through the pump and up the tubing string and not through the annulus, thereby reducing the pump's liquid pumping efficiency. This newly acquired understanding of the downhole performance of the well enabled corrective action to be taken, such installing a bigger pump or lowering the existing pump to capture a greater portion of the oil and less of the gas which ideally should report to the annulus.

While certain embodiments have been chosen to illustrate the subject invention it will be understood that various changes and modifications can be made therein without departing from the scope of the invention as defined in the appended claims.

The embodiments of the invention in which an exclusive property or privilege is claimed are defined as follows:

1. A method for creating a simulated solution gas curve for oil produced from a crude oil well, said well having a tubing string extending through the casing string of a wellbore and forming an annular space therebetween, said tubing string having a bore for delivering pumped crude oil to the surface at a known oil production rate, the oil being produced from a subterranean reservoir initially at the crude oil's bubble-point or higher pressure, any gas within the annular space being produced, the method comprising:

(a) obtaining the bubble-point pressure condition of the crude oil;

(b) determining the gas flow rate produced from the annular space;

(c) determining the flowing bottom hole pressure of the well;

(d) normalizing the annular space gas flow rate by dividing by the oil production rate;

(e) comparing the normalized annular gas flow rate to the reduction in pressure from the bubble-point pressure to the flowing bottom hole pressure as representing a linear relationship of the quantity of solution gas released from the produced oil as its pressure is reduced; and (f) creating a simulated solution gas curve representing the gas-oil ratio of solution gas contained in the oil at any pressure by forcing the intersection of said linear relationship through the conditions at zero solution gas remaining to be released from the oil at zero gauge pressure, where atmospheric pressure equals zero gauge pressure.

2. The method as recited in claim 1 wherein the simulated solution gas curve is solved at the bubble-point pressure to determine the total gas flow released from the crude oil and produced from the well.

3. The method as recited in claim 1 wherein the linear relationship is, $$Q = \frac{Q_{ann}}{(P_b - P_{wf})} P$$

where

Q is the solution gas contained in the crude oil at any pressure P, $P_b$ is the bubble-point pressure, $P_{wf}$ is the flowing bottom hole well pressure, and $Q_{ann}$ is the annular gas flow rate.

4. The method as recited in claim 2 wherein the total gas rate is determined from the relationship, $$Q_s = Q_{ann} + Q_{ann} \frac{P_{wf}}{P_b - P_{wf}}$$

where $P_b$ is the bubble-point pressure, $P_{wf}$ is the flowing bottom hole well pressure, $Q_{ann}$ is the annular gas flow rate, and $Q_s$ is the total gas liberated as the crude oil pressure is reduced from $P_b$ to zero gauge pressure, where atmospheric pressure equals zero gauge pressure.

5. A method for creating a simulated solution gas curve for oil produced from a crude oil well, said well having a tubing string extending through the casing string of a wellbore and forming an annular space therebetween, said tubing string having a bore for delivering pumped crude oil to the surface at a known oil production rate, the oil being produced from a subterranean reservoir initially at the crude oil's bubble-point or higher pressure, any gas within the annular space and being released from the oil being produced, the method comprising:

(a) obtaining the bubble-point of the crude oil;

(b) determining the total gas flow rate produced from the well;

(d) normalizing the total gas flow rate by dividing by the oil production rate;

(f) creating a simulated solution gas curve representing the gas-oil ratio of solution gas contained in the oil at any pressure by establishing a linear relationship between the conditions at the normalized total gas flow rate at the bubble point pressure and the conditions at zero solution gas remaining to be released from the oil at zero gauge pressure, where atmospheric pressure equals zero gauge pressure.

6. The method as recited in claim 5 wherein the linear relationship is, $$Q = \frac{Q_s}{P_b} P$$

where

Q is the solution gas contained in the crude oil at any pressure P, $Q_s$ is the total gas liberated as the crude oil pressure is reduced from $P_b$ to zero pressure, where atmospheric pressure equals zero gauge pressure, and $P_b$ is the bubble-point pressure.

7. The method as recited in claim 5 further comprising:

determining the flowing bottom hole pressure wherein the annular gas flow rate $Q_{ann}$ is determined from the relationship, $$Q_{ann} = \frac{Q_s}{1 + \frac{P_{wf}}{P_b - P_{wf}}}$$

where $P_b$ is the bubble-point pressure, $P_{wf}$ is the flowing bottom hole well pressure, $Q_s$ is the total gas flow liberated as the crude oil pressure is reduced from $P_b$ to zero pressure, where atmospheric pressure equals zero gauge pressure.

* * * * *